US005322457A

United States Patent [19]

Tsuji et al.

[11] Patent Number: 5,322,457

[45] Date of Patent: Jun. 21, 1994

[54] CONNECTOR WITH SEPARATE TERMINAL RETAINER

[75] Inventors: Masanori Tsuji; Motohisa Kashiyama; Ayato Nishimura, all of Shizuoka, Japan

[73] Assignee: Yazaki Corporation, Tokyo, Japan

[21] Appl. No.: 9,145

[22] Filed: Jan. 26, 1993

[30] Foreign Application Priority Data

Feb. 4, 1992 [JP] Japan ..... 4-018815

[51] Int. Cl.[5] ..... H01R 13/436

[52] U.S. Cl. ..... 439/595; 439/752

[58] Field of Search ..... 439/595, 597-599, 439/752

[56] References Cited

U.S. PATENT DOCUMENTS

| | | | |
|---|---|---|---|
| 4,660,915 | 4/1987 | Mantlik | 439/595 |
| 5,037,336 | 8/1991 | Betsui | 439/752 |
| 5,071,373 | 12/1991 | Nagasaka et al. | 439/595 |
| 5,141,452 | 8/1992 | Yoneda et al. | 439/752 |
| 5,145,419 | 9/1992 | Yamanashi et al. | 439/752 |
| 5,183,418 | 2/1993 | Yamanashi et al. | 439/595 |

*Primary Examiner*—P. Austin Bradley

*Attorney, Agent, or Firm*—Sughrue, Mion, Zinn, Macpeak & Seas

[57] ABSTRACT

A connector including a separate terminal retainer for retaining terminals in a connector housing where the retainer can be disengaged from the connector housing without the use of external jigs. The connector includes the connector housing having a plurality of terminal accommodating chambers, and the terminal retainer adapted to be connected to a rear portion of the connector housing in a two-step manner, i.e. a provisional engagement condition and a complete engagement condition, and movable relative to the connector housing. The terminal retainer has flexible retaining pieces and flexible support pieces. In the complete engagement condition, the flexible retaining pieces are engaged with respective metal terminals by their own flexibility, and the flexible support pieces are guided and elastically bent by the drive surfaces of the connector housing to be engaged with respective metal terminals. When the terminal retainer is moved backward from the complete engagement condition beyond the provisional engagement condition, the flexible retaining pieces ride onto projections of the connector housing to be displaced out of the locus of movement of the metal terminals being removed. The metal terminal can be easily removed from the connector housing without using any jigs.

8 Claims, 6 Drawing Sheets

CONNECTOR WITH SEPARATE TERMINAL RETAINER

BACKGROUND OF THE INVENTION

1. Field of the Invention

The present invention relates to a connector with a separate terminal retainer, which is used for connecting wire harnesses or the like.

2. Background

Referring to FIG. 11, a metal terminal c, to which an electric wire w is connected, is inserted into a terminal accommodating chamber $a_1$ of a connector a and retained therein by a flexible retaining arm d. The flexible retaining arm d has a step $d_1$ at its distal end which is engaged with a rear end of a female electric contact portion $c_1$ of the metal terminal c.

A terminal retainer b also shown in FIG. 11 is located at a provisional retaining position where engagement ends $e_1$ of a pair of flexible retaining pieces are displaced from the female electric contact portion $c_1$. The terminal retainer b advances from the provisional retaining position to a complete retaining position where the engagement ends $e_1$ of the flexible retaining pieces abut against the rear end of the female electric contact portion $c_1$ at both sides of the flexible retaining arm d.

FIG. 13 shows a first terminal removing jig $t_1$. The jig $t_1$ has a grip portion f and a two-pronged drive portion $f_1$ on an end of the grip portion f. FIG. 14 shows a second terminal removing jig $t_2$ having a tapered drive portion $g_1$ on an end of a grip portion g.

The operation for removing the metal terminal c from the connector a using these first and second jigs $t_1$ and $t_2$ will be described hereunder. The terminal retainer b is first moved backwardly from the complete retaining position to the provisional retaining position as shown in FIG. 11. Thereafter, the first terminal removing jig $t_1$ is inserted through an insertion portion h of the terminal retainer b into the terminal accommodating chamber $a_1$ so that the two-pronged drive portion $f_1$ is brought into contact with the engagement ends $e_1$ of the pair of the flexible retaining pieces e while the wire w and the metal terminal c is located in an interior $f_2$ (i.e., between the two prongs) of the two-pronged drive portion $f_1$, as shown in an upper half of FIG. 12. Thereafter, as shown in a lower half of FIG. 12, the grip portion f is pivotably moved downwardly using the electric wire w as a fulcrum so that the engagement ends $e_1$ are moved upwardly by the two-pronged drive portion $f_1$. Thereafter, the second terminal removing jig $t_2$ is inserted from the front of the connector housing a into the terminal accommodating chamber $a_1$ so that the engagement step $d_1$ of the flexible retaining arm d is moved upwardly and disengaged from the metal terminal c. In a state where the engagement step $d_1$ is maintained in the disengaged position, the metal terminal c is removed from the connector a together with the first terminal removing jig $t_1$.

In the connector described above, the metal terminal c is double-retained by the flexible retaining arm d of the connector housing a and the flexible retaining piece e of the terminal retainer b to prevent backward withdrawal thereof relative to the connector housing a. However, in order to remove the metal terminal c from the connector housing a, two jigs must be used to independently disengage the flexible retaining arm d and the flexible retaining piece e from the metal terminal c, resulting in a troublesome operation.

SUMMARY OF THE INVENTION

The present invention was made in view of the above-mentioned difficulties. Accordingly, it is an object of the present invention to enable easy removal of the metal terminal, which is subjected to double retainment in a connector housing, without using any jigs.

In order to attain the above-noted and other objects, the present invention provides a connector which includes a connector housing having a plurality of terminal accommodating chambers and a terminal retainer adapted to be connected to a rear portion of the connector housing in a two-step manner, i.e. a provisional engagement condition and a complete engagement condition, and movable relative to the connector housing, the terminal retainer having flexible retaining pieces and flexible support pieces. In the complete engagement condition of the connector, each of the flexible retaining pieces is engaged with a corresponding metal terminal alone, and each of the flexible support pieces is elastically bent by a drive surface of the connector housing so as to be engaged with the corresponding metal terminal. When the terminal retainer is moved from the complete engagement condition backward beyond the provisional engagement condition, each of the flexible retaining pieces rides onto a projection of the connector housing to be displaced out of the locus of the metal terminal being removed. If the terminal retainer is moved backward from the complete engagement condition to the provisional engagement condition, each of the flexible support pieces becomes free from the drive surface so as to be elastically restored to be displaced out of the locus of movement of the terminal.

The connector may further includes means, provided on each of the flexible retaining pieces, for forcibly displacing corresponding flexible support pieces out of the locus of movement when each of the flexible retaining pieces rides onto the projection.

The present invention further provides a connector which includes a connector housing having at least one terminal accommodating chamber in which a metal terminal is received and a separate terminal retainer adapted to be coupled to the connector housing, the terminal retainer having first and second retaining means for retaining the metal terminal in the terminal accommodating chamber.

Preferably, the connector further includes: a first positioning means for positioning the terminal retainer coupled to the connector housing at a complete engagement position where both the first and second retaining means are engaged with the metal terminal; a second positioning means for positioning the terminal retainer coupled to the connector housing at a provisional engagement position where the first retaining means allows the metal terminal to be inserted into the terminal accommodating chamber and prevents the metal terminal inserted into the terminal accommodating chamber from being removed therefrom, and the second retaining means is prevented from being engaged with the metal terminal; and a third positioning means for positioning the terminal retainer coupled to the connector housing at a terminal removing position where both the first and second retaining means are prevented from being engaged with the metal terminal.

DETAILED DESCRIPTION OF THE PREFERRED EMBODIMENTS

Figure 1:
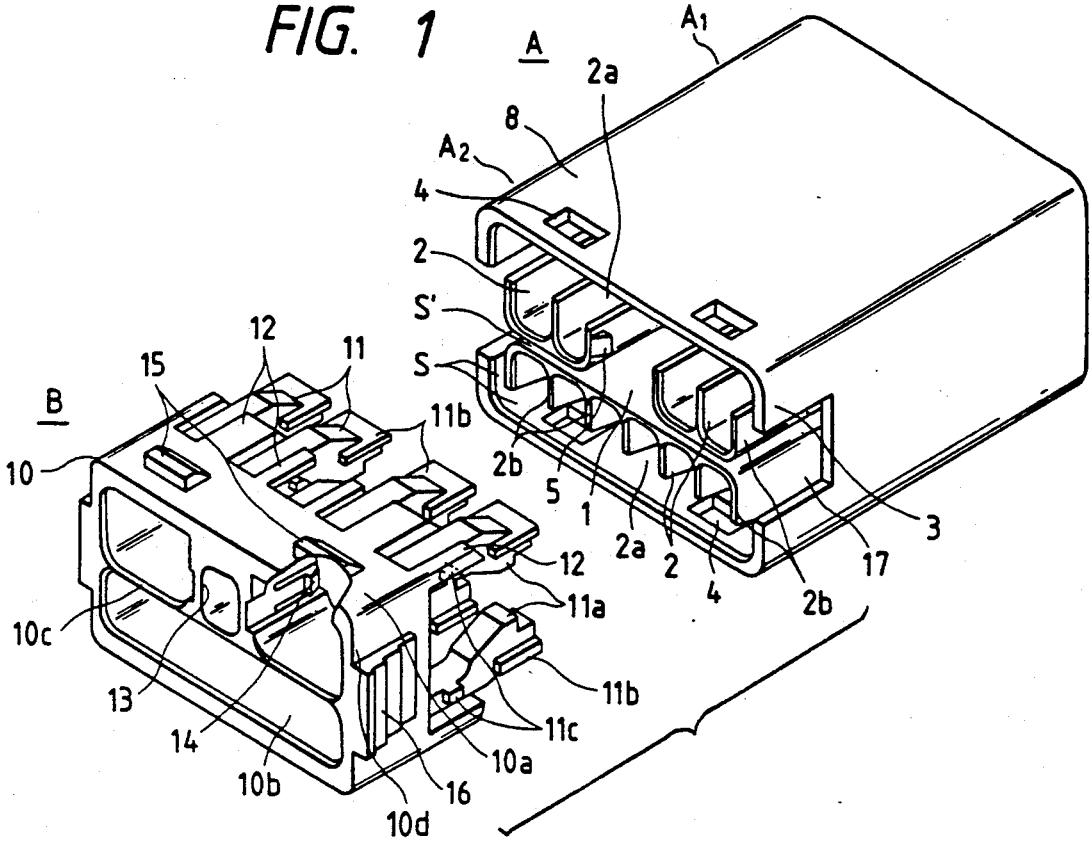
FIG. 1 is an exploded perspective view showing a connector housing and a terminal retainer, as viewed from a rear thereof, according to an embodiment of the present invention.

A preferred embodiment of the present invention will now be described in detail with reference to the drawing attached hereto.

In FIG. 1, reference numerals A and B respectively denote a female connector housing and a terminal retainer, each of which is formed of synthetic resin as an integral structure.

The female connector housing A includes a cover portion $A_1$ at its front half and a terminal accommodating chamber group portion $A_2$ at its rear half. In an upper half of the terminal accommodating chamber group portion $A_2$, two pairs of juxtaposed terminal accommodating chambers 2 are provided in a parallel relation to each other with an accommodating space 1 disposed therebetween. In a lower half thereof, six terminal accommodating chambers 2 are juxtaposed in a continuous manner. Each of the terminal accommodating chambers 2 in the upper and lower halves of the portion $A_2$ has an opening 2*a* directed upwardly or downwardly.

Figure 6:
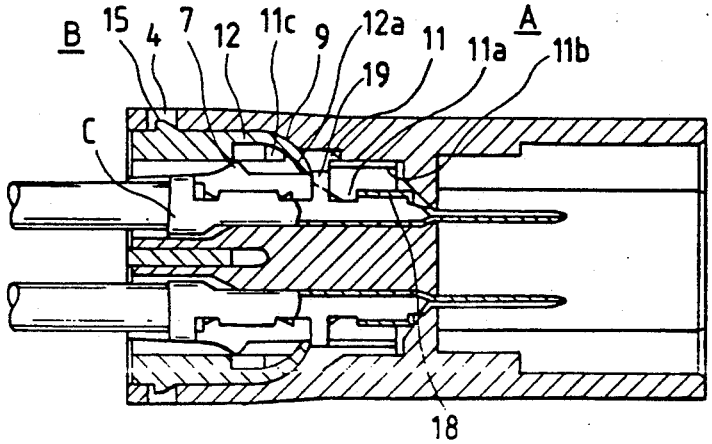
FIG. 6 is a cross-sectional view showing the connector housing and the terminal retainer completely connected to each other.

A hood 3 is provided around an outer periphery of a rear portion of the terminal accommodating chamber group portion $A_2$ with an annular space S therebetween. The hood 3 is formed at its upper and lower portions with engagement portions 4 for facilitating complete engagement with the terminal retainer B, as shown in FIG. 6. A withdrawal preventing projection 5 for the terminal retainer B is formed on a side of each partition wall 2*b* of the terminal accommodating chambers 2 facing the accommodating space 1. A gap S' is also formed between the upper and lower halves of the terminal accommodating chamber group portion $A_2$.

Figure 3:
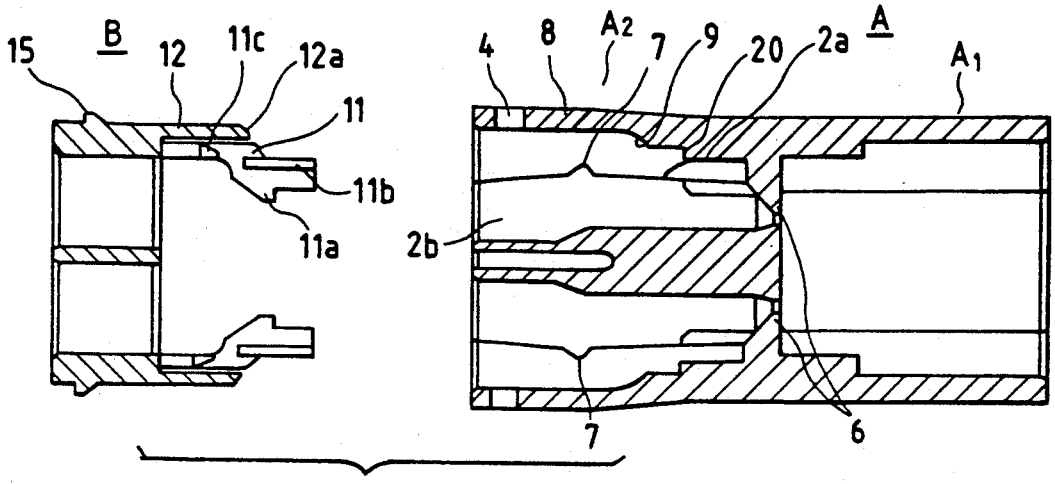
FIG. 3 is a cross-sectional view showing the connector housing and the terminal retainer separated from each other.

As shown in FIG. 3, a stopper wall 6 for a metal terminal c is provided at a front portion of each terminal accommodating chamber 2. An engagement projection 7 for provisionally engaging the terminal retainer B is provided on an end of each of partition walls 2*b* which define the terminal accommodating chambers 2. The engagement projection 7 has an arcuate shape and is located on the side adjacent the opening 2*a*. Sloped drive surfaces 9 are formed on an inner surface of a wall 8 confronting the partition walls 2*b* across the annular space S.

Figure 8:
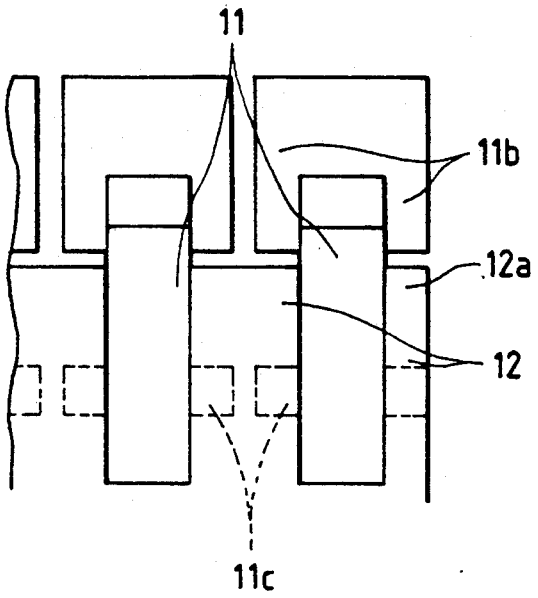
FIG. 8 is a plane view showing a major part of the terminal retainer.
Figure 9:
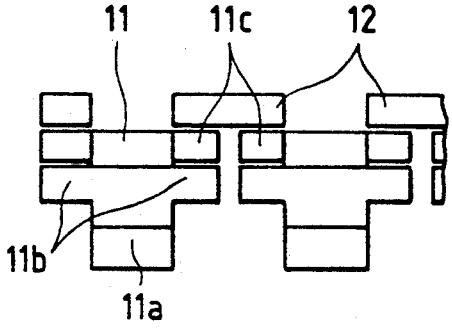
FIG. 9 is a front view showing the major part of the terminal retainer.
Figure 10:
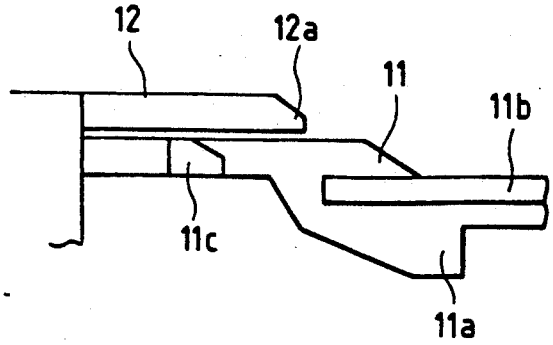
FIG. 10 is a side view showing the major part of the terminal retainer.
Figure 11:
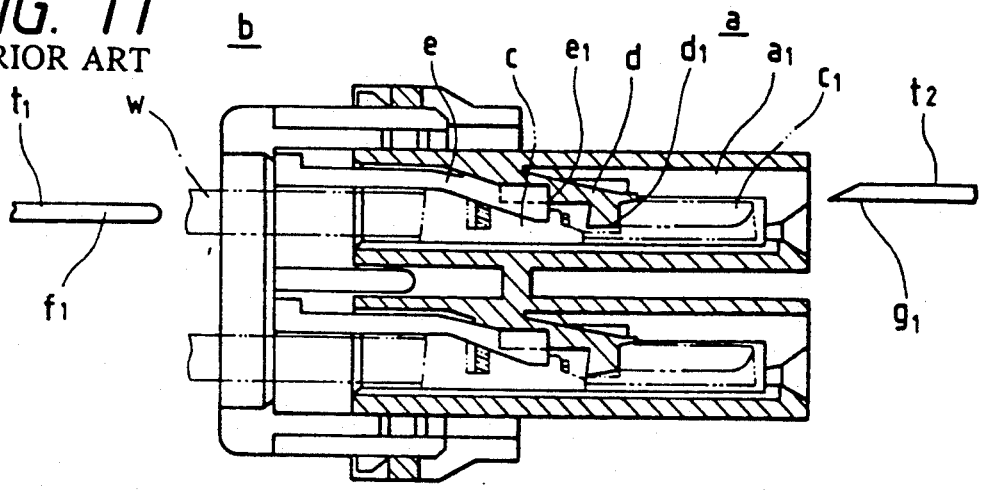
FIG. 11 PRIOR ART
FIG. 11 is a cross-sectional view showing a conventional connector with a terminal retainer.
Figure 12:
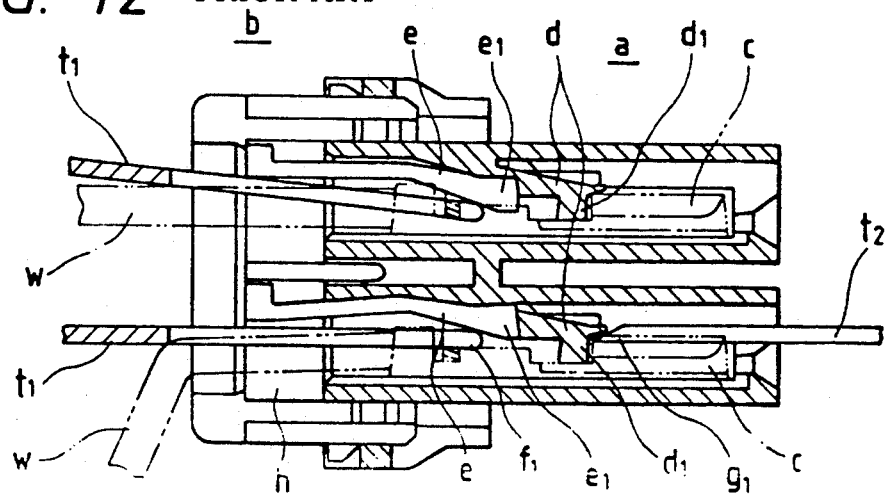
FIG. 12 PRIOR ART
FIG. 12 is a cross-sectional view showing the conventional connector from which metal terminals are to be removed.
Figure 13:
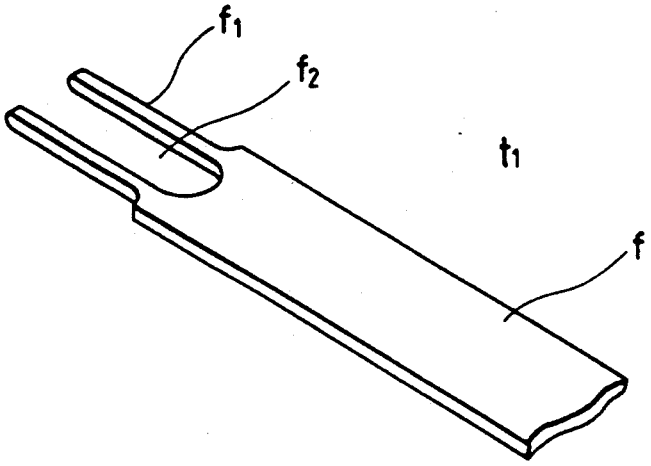
FIG. 13 PRIOR ART
FIG. 13 is a perspective view showing a terminal removing jig.
Figure 14:
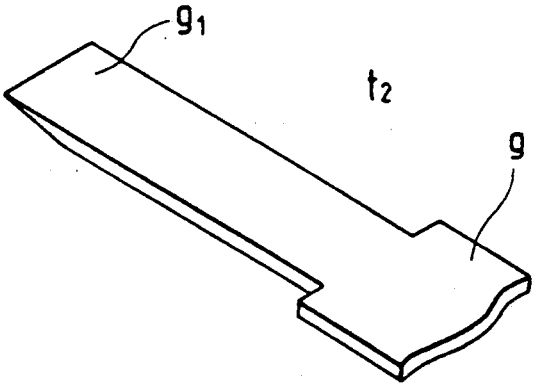
FIG. 14 PRIOR ART
FIG. 14 is a perspective view showing another terminal removing jig.

Referring also to FIGS. 8–10, the terminal retainer B has a main frame portion 10 formed by upper and lower plate portions 10*a* and 10*b*. Each of the upper and lower plate portions 10*a* and 10*b* has flexible retaining pieces 11 extending forwardly and corresponding to respective terminal accommodating chambers 2. The flexible retaining pieces 11 are located at a relatively inner portion of the upper and lower plate portions 10*a* and 10*b* in the thickness direction thereof. Provided on the outer portion of the upper and lower plate portions 10*a* and 10*b* are flexible support pieces 12, one of which is disposed on each side of each flexible retaining piece 11.

Each flexible retaining piece 11 has a terminal retaining projection 11*a* at its distal end portion, and a retaining tab 11*b* projecting transversely (i.e. in right and left directions of FIG. 9). A pair of correction projections 11*c* project transversely from opposite sides of each flexible retaining piece 11 so as to be abutable against intermediate portions of inner surfaces of respective flexible support pieces 12. The correction projections 11*c* are located on each flexible retaining piece 11 at a position that is to the rear of the retaining tab 11*b*.

An intermediate plate portion 10*c* is provided within the main frame portion 10 of the terminal retainer B. The terminal retainer B has a fitted portion 13 provided between the upper plate portion 10*a* and the intermediate plate portion 10*c* and adapted to be fitted into the accommodation space 1 of the connector housing A. Engagement pieces 14 are formed on both sides of the fitted portion 13 so as to be engagable with the withdrawal prevention projections 5.

Figure 2:
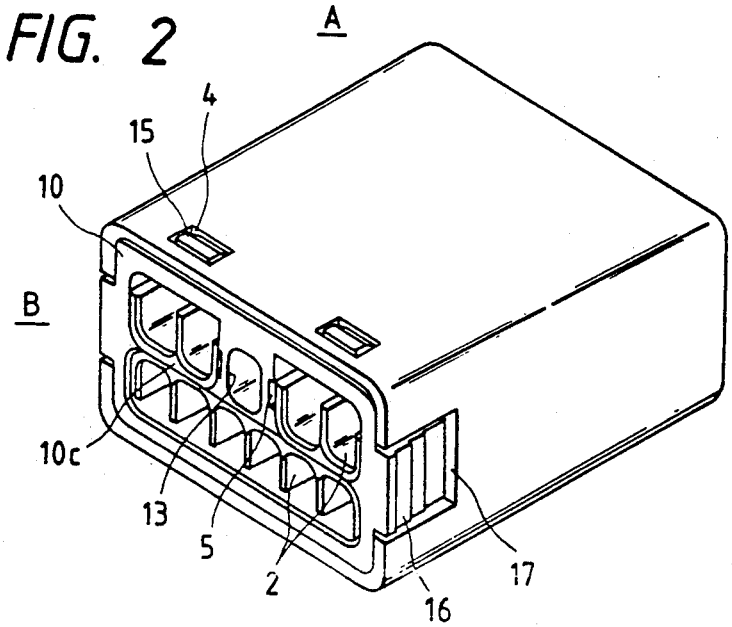
FIG. 2 is a perspective view showing the connector housing and the terminal retainer completely connected to each other.

Projections 15 are provided on the outer surfaces of the upper and lower plate portions 10*a* and 10*b* so as to be engagable with the engagement portions 4 for the complete engagement between the connector housing A and the terminal retainer B. Operation projections 16 are provided on side plates 10*d* of the main frame portion 10 so as to correspond to notched portions 17 provided in the rear portion of the connector housing A as shown in FIG. 2.

Figure 4:
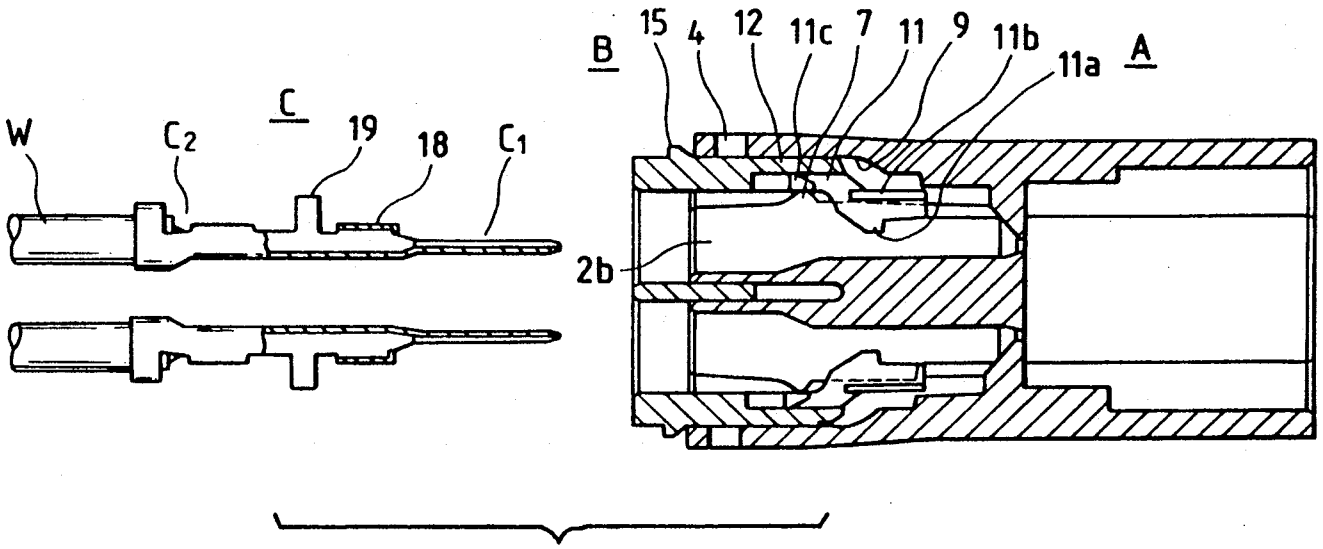
FIG. 4 is a cross-sectional view showing the connector housing and the terminal retainer provisionally connected to each other.

As shown in FIG. 4, each metal terminal c has an intermediate retaining portion 18 between an electric contact portion $c_1$ in the form of male tab and an electric connection portion $c_2$. A pair of protruding pieces 19 such as stabilizers are provided on both sides of the metal terminal c between the electric connection portion $c_2$ and the intermediate retaining portion 18.

In the connector thus constructed, the terminal retainer B is provisionally engaged with or connected to the connector housing A. For the provisional engagement, the terminal retainer B is inserted into the connector housing A such that flexible retaining pieces 11, the flexible support pieces 12, and the upper and lower plate portions 10*a* and 10*b* are inserted into corresponding upper and lower portions of the annular space S while the intermediate plate portion 10*c* is inserted into the gap S'. During this insertion, the engagement pieces 14 of the terminal retainer B is moved beyond the withdrawal preventive projections 5 of the connector housing A. When the retaining tabs 11*b* of the flexible retaining pieces 11 advance beyond the provisional engagement projections 7 so as to be engaged therewith, the terminal retainer B is placed into the provisional engagement condition with the connector housing A (FIG. 4).

In the provisional engagement condition as shown in FIG. 4, the complete engagement projections 15 are brought into abutment with the rear end of the outer wall 8 of the connector housing A so as to prevent the terminal retainer B from being unintentionally moved into the connector housing A any further. In addition, the withdrawal prevention projections 5 in the provisional engagement condition are deviated from the engagement pieces 14 so as not to be engaged therewith.

In the provisional engagement condition, a metal terminal c, to which an electric wire w is connected, is inserted into each terminal accommodating chamber 2. During this insertion, the intermediate retaining portion 18 of the metal terminal is brought into contact with the terminal retaining projection 11*a* so that the flexible retaining piece 11 is displaced outwardly through the opening 2*a*, is moved beyond the terminal retaining projection 11*a*, and is bought into abutment with the stopper wall 6, resulting in the metal terminal c being primarily retained by the flexible retaining piece 11 against the rearward withdrawal thereof (FIG. 5).

Thereafter, the terminal retainer B is further inserted into the connector housing A causing the upper and lower plate portions 10*a* and 10*b* to be elastically deformed inwardly until the complete engagement projections 15 become engaged with the engagement portions 4 (FIG. 6). In this complete engagement condition as shown in FIG. 6, the flexible support pieces 12 of the terminal retainer B are bent along the sloped drive surfaces 9 of the wall 8 of the connector housing A so that the distal ends 12*a* of the flexible support pieces 12 are engaged with the protruding pieces 19 of the metal terminal c, resulting in secondary locking of the metal terminal c by the flexible support pieces 12.

Figure 5:
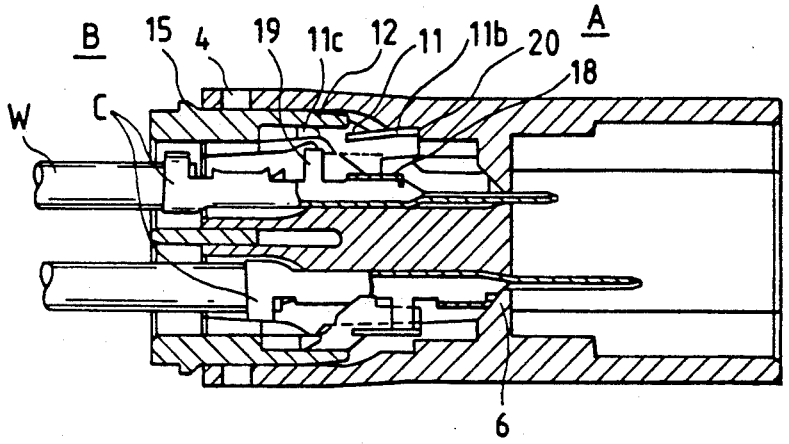
FIG. 5 is a cross-sectional view showing the connector housing and the terminal retainer, into which metal terminals are inserted.

In a case where there are some incompletely inserted metal terminals c in the provisional engagement condition, the intermediate retaining portion 18 of each incompletely inserted terminal c moves the flexible retaining piece 11 upward, so that the distal end of the flexible retaining piece 11 is brought into abutment with a step 20 formed in the terminal accommodating chamber 2 (FIG. 5). Therefore, the terminal retainer B cannot be further inserted into the connector housing A and moved to the complete engagement condition.

Figure 7:
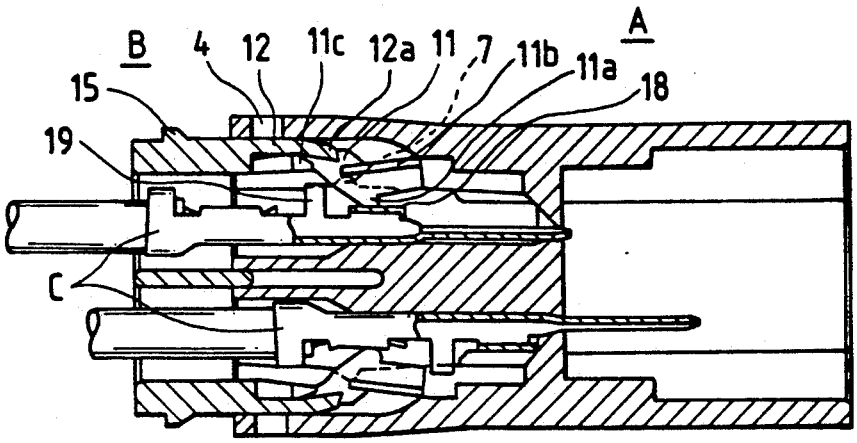
FIG. 7 is a cross-sectional view showing the connector housing and the terminal retainer in the condition where the metal terminal is to be removed therefrom.

If a metal terminal c needs to be replaced with another terminal due to damage or the like, the complete engagement projections 15 is disengaged from the engagement portions 4. Thereafter, the terminal retainer B is withdrawn from the connector housing A until the engagement pieces 14 engage the withdrawal prevention projections 5 whereupon the engagement tab 11*b* of the flexible retaining piece 11 is moved onto the arcuate-like provisional retaining projections 7 of the partition walls 2*b*. As a result, the terminal retaining projection 11*a* is displaced outwardly while the distal ends 12*a* of the flexible support pieces 12 are moved away from the sloped drive surfaces 9 to restore the flexible support pieces 12 to their straight configuration and to displace the flexible support pieces 12 out of the locus of movement of the metal terminal c being removed. In this state, the metal terminal c can be simply removed from the connector housing A without using any jigs (FIG. 7). During this motion, the correction projections 11*c* forcibly move the flexible support pieces 12 out of the locus of the removed metal terminal c even if the flexible support pieces 12 are insufficiently restored by their own flexibility.

A connector according to the present invention includes a connector housing having a plurality of terminal accommodating chambers, and a terminal retainer adapted to be connected to a rear portion of the connector housing in a two-step manner, i.e. a provisional engagement condition and a complete engagement condition, and movable relative to the connector housing. The terminal retainer has flexible retaining pieces and flexible support pieces. In the complete engagement condition, the flexible retaining pieces are engaged with respective metal terminals by their own flexibility, and the flexible support pieces are guided and elastically bent by the drive surfaces of the connector housing to be engaged with respective metal terminals. When the terminal retainer is moved from the complete engagement condition backward beyond the provisional engagement condition, the flexible retaining pieces ride onto projections of the connector housing to be displaced out of the locus of movement of the metal terminals. Accordingly, each metal terminal can be double-retained by the flexible retaining piece and the flexible support pieces both provided in the terminal retainer. Further, if the terminal retainer is moved backward from the complete engagement condition to the provisional engagement condition, the flexible support pieces become free from the drive surfaces, so that the flexible support pieces are elastically restored to be displaced out of the locus of movement of the metal terminals. When the terminal retainer is further moved backward from the provisional engagement condition, the flexible retaining pieces ride on the projections so as to be displaced out of the locus of movement of the metal terminals. Accordingly, the metal terminals can be easily removed from the connector housing without using any jigs in a state where the terminal retainer is released from the complete engagement condition and displaced backward relative to the connector housing.

What is claimed is:

1. A connector, comprising:

a connector housing having a plurality of terminal accommodating chambers; and a terminal retainer movable relative to said connector housing so as to be connectable to a rear portion of said connector housing in a provisionally engaged position and a completely engaged position, said terminal retainer having flexible retaining pieces and flexible support pieces;

wherein said connector housing includes support piece deflecting means for elastically deflecting each of said flexible support pieces as said retainer is moved to said completely engaged position and retaining piece deflecting means for deflecting said retaining pieces outwardly when said retainer is moved rearwardly beyond said provisionally engaged position; and wherein in said completely engaged position, each of said flexible retaining pieces is engaged with a corresponding metal terminal, and each of said flexible support pieces is elastically deflected by said support deflecting means of said connector housing so as to be engaged with said corresponding metal terminal, and when said terminal retainer is moved from said completely engaged position backward beyond said provisionally engaged position, each of said flexible retaining pieces is deflected by said retaining piece deflecting means as so to be displaced out of a locus of movement of said metal terminal to allow removal thereof.

2. The connector of claim 1, wherein said support piece deflecting means includes a drive surface provided on said connector housing.

3. The connector according to claim 2, wherein when said terminal retainer is moved backwardly from said completely engaged position to said provisionally engaged position, each of said flexible support pieces becomes free from said drive surface so as to be elastically restored to be displaced out of said locus.

4. The connector of claim 2, wherein said retaining piece deflecting means includes a projection provided in said connector housing.

5. The connector according to claim 4, wherein each of said retaining pieces includes means for forcibly displacing corresponding flexible support pieces out of said locus when each of said flexible retaining pieces rides onto said projection.

6. A connector, comprising:

a connector housing having at least one terminal accommodating chamber in which a metal terminal is received;

a separate terminal retainer adapted to be coupled to said connector housing, said terminal retainer having first and second retaining means for retaining said metal terminal in said terminal accommodating chamber; and first positioning means for positioning said terminal retainer coupled to said connector housing at a provisionally engaged position where said first retaining means allows said metal terminal to be inserted into said terminal accommodating chamber and prevents said metal terminal inserted into said terminal accommodating chamber from being removed therefrom, and said second retaining means is prevented from being engaged with said metal terminal.

7. The connector according to claim 6, further comprising:

a second positioning means for positioning said terminal retainer coupled to said connector housing at a completely engaged position where both said first and second retaining means are engaged with said metal terminal.

8. The connector according to claim 6, further comprising:

a third positioning means for positioning said terminal retainer coupled to said connector housing at a terminal removing position where both said first and second retaining means are prevented from being engaged with said metal terminal.

* * * * *